US005186611A

United States Patent [19]

Frandsen

[11] Patent Number: 5,186,611

[45] Date of Patent: Feb. 16, 1993

[54] PUMP ARRANGEMENT FOR PUMPING LIQUID BY MEANS OF COMPRESSED AIR

[76] Inventor: Aksel S. Frandsen, Sellerupstrandvej 7, Brejning Strand, DK - 7080 Borkop, Denmark

[21] Appl. No.: 836,723

[22] Filed: Feb. 19, 1992

Related U.S. Application Data

[63] Continuation-in-part of Ser. No. 556,552, Jul. 20, 1990.

[51] Int. Cl.[5] ..... F04F 3/00

[52] U.S. Cl. ..... 417/138; 417/144; 417/145; 415/182.1

[58] Field of Search ..... 415/182.1; 417/87, 137, 417/138, 140, 144, 145

[56] References Cited

U.S. PATENT DOCUMENTS

| | | | |
|---|---|---|---|
| 1,362,858 | 12/1920 | Engles et al. | 417/137 |
| 2,360,038 | 10/1944 | Burton | 417/145 |
| 3,915,593 | 10/1975 | Chamberlain | 417/138 |
| 3,930,755 | 1/1976 | Lahr et al. | 417/138 |
| 4,439,110 | 3/1984 | Massaux | 417/138 |
| 4,725,202 | 2/1988 | Zison | 417/138 |

FOREIGN PATENT DOCUMENTS

| | | | |
|---|---|---|---|
| 0636323 | 2/1962 | Canada | 417/140 |

*Primary Examiner*—John T. Kwon
*Assistant Examiner*—Christopher Verdier
*Attorney, Agent, or Firm*—Leonard Bloom

[57] ABSTRACT

A pump arrangement that has a pump chamber with an inlet opening and a discharge opening. A discharge pipe is connected to the outlet opening to carry liquid, etc., from the pump chamber. An inlet pipe is connected to the inlet opening and extends downwardly therefrom into the liquid to carry liquid, etc., to the pump chamber. The inlet opening is formed in the pump chamber above the discharge opening. A supply pipe is connected between a source of compressed air and the pump chamber. The supply pipe selectively either supplies compressed air to the pump chamber for exhausting liquid, etc., therefrom via the outlet opening and the discharge pipe or vents the air for intaking liquid, etc., into the pump chamber via the inlet pipe and the inlet opening. The inlet pipe is valve-free, whereby the inlet pipe is open during the entire operation of the pump arrangement so that the pump may pump liquids containing solid objects.

7 Claims, 3 Drawing Sheets

PUMP ARRANGEMENT FOR PUMPING LIQUID BY MEANS OF COMPRESSED AIR

CROSS-REFERENCE TO RELATED APPLICATION

This application is a continuation-in-part of co-pending application Ser. No. 556,552 filed Jul. 20, 1990, the disclosure of which is incorporated by reference herein in its entirety.

FIELD OF THE INVENTION

The present invention relates to a pump arrangement for pumping liquid by compressed air.

DESCRIPTION OF THE RELATED ART

Pump arrangements for pumping liquid by compressed air are known, e.g., from Norwegian Patent No. 4,100; French Patent Nos. 806,643 and 1,033,695; and U.S. Pat. No. 1,072,562.

These known pumps all have a valve on the inlet side (an inlet valve) which closes when compressed air is blown into the pump chamber.

SUMMARY OF THE INVENTION

It is the purpose of the present invention to provide a pump in which the valve on the inlet side (the inlet valve) can be omitted, thus making the pump simpler in its construction and more robust and dependable than known pumps. This is achieved by forming the pump so as to have a discharge pipe connected to the discharge opening at the bottom of the pump chamber. Preferably, this connection is made by a U-shaped bend formed in the discharge pipe. The inlet opening of the pump chamber is connected to an inlet pipe. The inlet pipe extends from the inlet opening down into the liquid being pumped to a level where the pressure head thereof is higher than the pressure head of the pump arrangement. Preferably, the inlet pipe further extends down into the liquid to a position being lower than the position where the lowest part of the pump chamber is located. Finally, the inlet opening of the pump chamber is disposed at a level being higher than the level at which the outlet opening of the pump chamber is disposed.

As the pump arrangement according to the present invention is open during the whole throughput action (the cyclic intake and exhaust pumping action), it can also pump liquids containing large objects, such as plastic bags, rope ends and the like. Furthermore, it can be used to pump water containing live fish.

The invention will be explained in detail below with reference to the drawings.

DESCRIPTION OF PREFERRED EMBODIMENTS

Figure 1A:
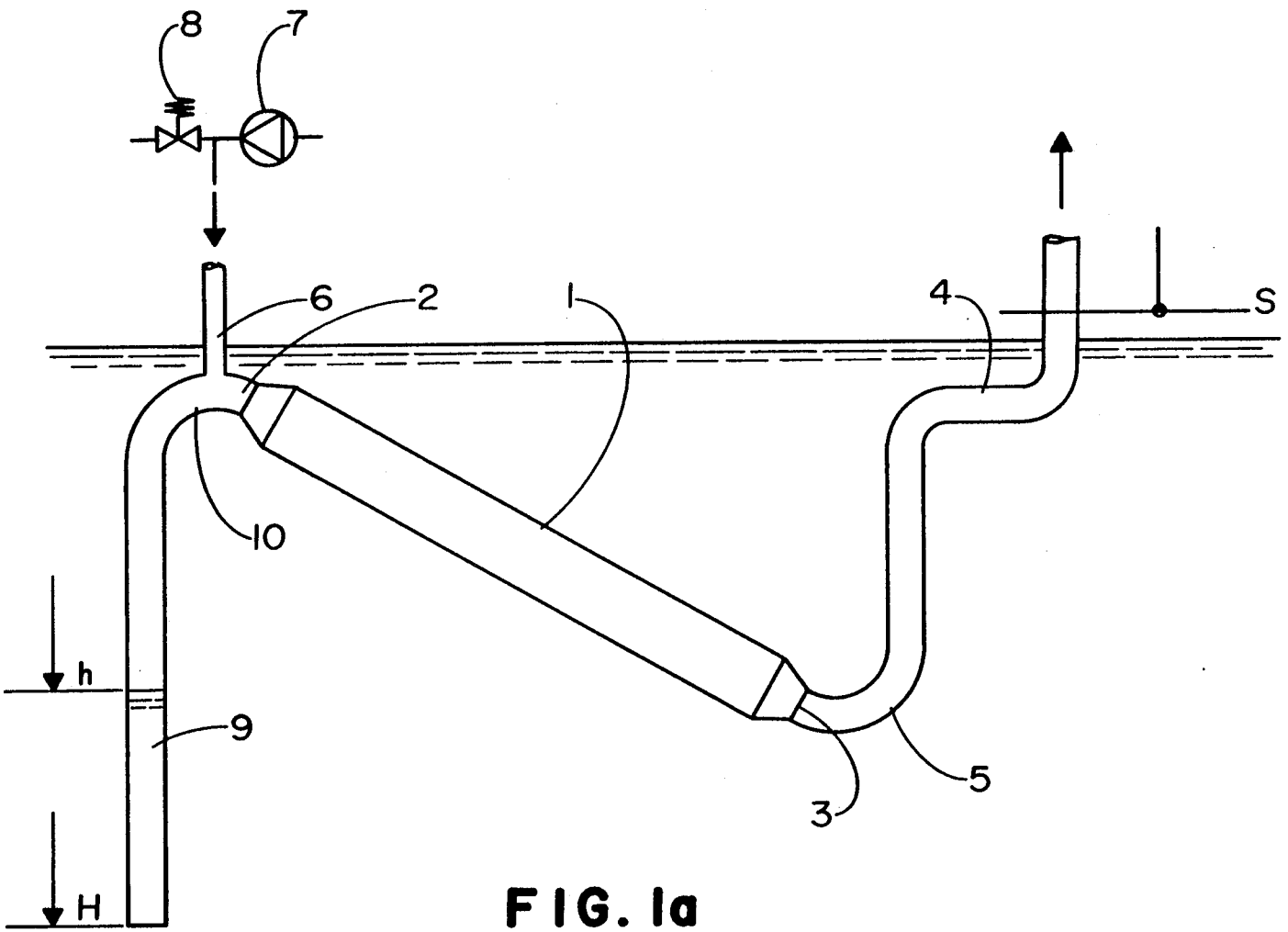
FIG. 1*a* is a schematic view of a first embodiment of the pump arrangement of the present invention showing the blower emptying the chamber.

As shown in the drawings, the pump arrangement of the present invention has a pump chamber 1. The pump chamber 1 which is immersed in liquid, has an inlet opening 2 and a discharge opening 3 formed therein. The discharge opening 3 is connected to a discharge pipe 4, preferably, by a U-shaped bend 5. A supply pipe 6 for compressed air is connected to the top part of the pump chamber 1. By way of example, the compressed air can be supplied from a blower 7, so that compressed air is pumped into the pump arrangement when a magnet control valve 8 is closed. The pump arrangement is aired to atmospheric pressure when the valve 8 is open. Operation of valve 8 may be controlled by a sensor S or any means well-known to those skilled in the art.

Connected to the inlet opening 2 of the pump chamber 1 is an inlet pipe 9. The inlet pipe 9 extends from the inlet opening 2 down into the liquid to a level where the pressure head H is higher than the pressure head h of the pump arrangement. Preferably, the inlet pipe 9 further extends down into the liquid to a level that is lower than the lowest part of the pump chamber The pump arrangement descried above may be supported and held in position by any static support structure well known to those skilled in the art.

Figure 2:
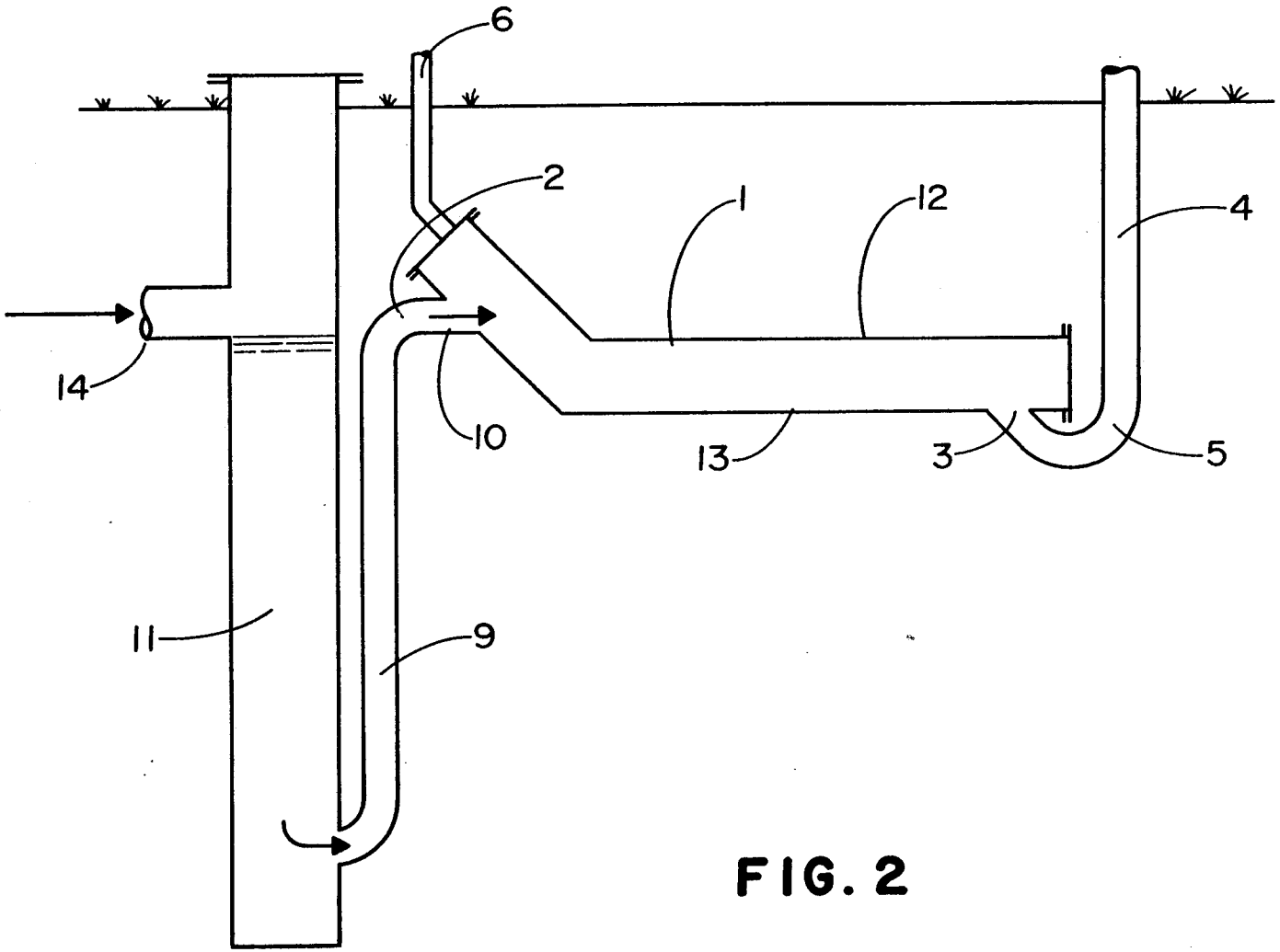
FIG. 2 is a schematic view of a second embodiment of the pump arrangement of the present invention.

Referring now to FIG. 2, the inlet pipe 9 can also enter a pump well 11 from which the pump arrangement pumps liquid. The pump well 11 receives the fluid therein via an inlet conduit 14 which, in turn, is in communication with a liquid reservoir. In such a case, the pump arrangement can be buried in the ground.

Returning now to FIGS. 1*a* and 1*b*, in addition to FIG. 2, the cyclic operation of the pump arrangement is described. The pump operates when the inlet opening 2 is submerged beneath the surface of the liquid to be pumped. When the pump chamber 1 is empty and the valve 8 is open, the compressed air from the blower 7 is vented to the ambient environment. Liquid is forced through the inlet pipe 9 and into the pump chamber 1 due to the pressure head H. In this fashion, the pump intakes fluid.

When the pump chamber 1 is filled with liquid and a corresponding liquid level in the discharge pipe 4 is reached, a sensor S (not shown) activates valve 8. The valve 8 will be closed and the blower 7 will force compressed air into the pump chamber 1.

As the pressure head H at the bottom of the inlet pipe 9 is greater than the pressure head h produced by the blower of the pump arrangement, the supplied compressed air will force the liquid out of the pump chamber 1 and out through the discharge pipe 4. In this fashion, the pump exhausts fluid.

When the pump arrangement is emptied of liquid, the sensor S causes the valve 8 to be opened, so that the pump arrangement will be vented to the ambient environment, whereby another volume of liquid is forced into the pump chamber. After the pump chamber refills and the level of liquid in the discharge pipe 4 reaches the sensor S, the cycle is repeated to empty the pump chamber 1.

The consumption of air is only a few percent higher than the volume of liquid being pumped. If a volume of liquid of 1 $m^3$ is to be raised 1 m, then a blower effect of 8W is needed. This effect is essentially lower than that needed for the known pumps.

The blower 7 can either be in continuous operation, or it can be connected to a control system for the valve 8, so that it is selectively stopped when the valve 8 is open.

As a fixed quantity of liquid is discharged, depending on the dimensions of the pump arrangement, for each pump stroke, the pump arrangement can also be used as a flow meter. Such a pump can send a signal to another pump, such as a dosing pump for chemicals.

Figure 1B:
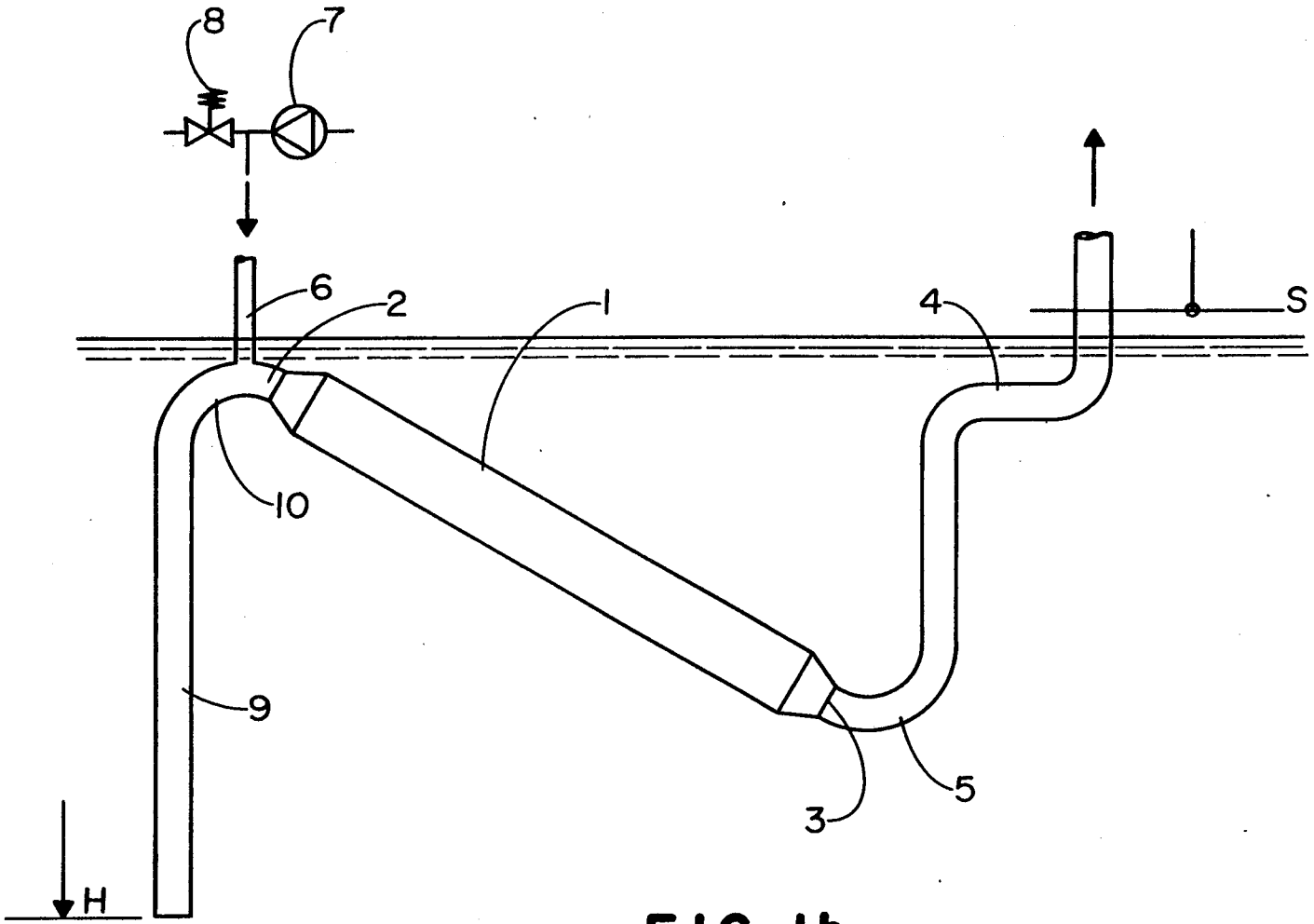
FIG. 1*b* is a schematic view of a first embodiment of the pump arrangement of the present invention showing the chamber filled with liquid.

As shown in FIGS. 1*a* and 1*b*, the pump chamber 1 can be embodied as an oblong, preferably cylindrical, pipe oriented with a backward slope from the inlet opening 2 towards the discharge opening 3. This gives the pump, with the inlet pipe 9, the pump chamber 1 and the discharge pipe 4, the shape of an N.

Referring in particular now to FIG. 2, the chamber 1 may also have the shape of an oblong, preferably cylindrical, pipe with a horizontal position.

With the embodiment shown in FIG. 2, the lower edge 10 of the inlet opening 2 is placed at a higher level than the upper edge 12 of the pump chamber 1. The pump arrangement then functions as a liquid pump.

If the lower edge 10 of the inlet opening 2 is moved down to a level which is lower than the upper edge 12 of the pump chamber 1, but higher than the pump chamber's lower edge 13, part of the liquid supplied to the pump chamber 1 will be taken back to the inlet pipe 9 during the pump stroke. If the fluid being pumped is sludgy, the sludge which collects on the bottom of the pump chamber 1 will thus be pumped away through the discharge pipe 4, whereas pure liquid will be taken back to the inlet pipe 9.

In the described embodiment, the pump arrangement can thus be used for the cleaning of waste water for sludge.

With the framework of the present invention, there may be other embodiments of the present invention. For example, the pump chamber shown in FIGS. 1*a* and 1*b* can be embodied with a beginning part with an inclined downward slope and then with a horizontal part and then with a part inclined downwards.

What is claimed is:

1. A pump arrangement for pumping liquid with compressed air, the pump arrangement being of the type having a pump chamber which is immersed in the liquid, the pump chamber having a top and a bottom, a discharge opening formed in the bottom of the chamber, a discharge pipe connected with the discharge opening and extending therefrom, a supply pipe extending between the top of the chamber and a source of compressed air for providing gaseous communication therebetween, whereby a pressure head is defined in the supply pipe and a valve disposed in the supply pipe for selectively alternatively permitting compressed air from the source thereof to pass into the chamber via the supply pipe and venting the compressed air from the source thereof to be vented to the ambient environment, the improvement upon the pump arrangement comprising:

the discharge pipe having a U-shaped bend formed therein, the entire U-shaped bend being located between the discharge opening and an end of the discharge pipe;

an inlet pipe connected to the pump chamber over the inlet opening thereof, the inlet pipe extending downwardly from the inlet opening and into the liquid where the inlet pipe terminates, such that liquid is supplied to the pump chamber via the inlet pipe and the inlet opening, and whereby a pressure head is defined where the inlet pipe terminates in the liquid;

the inlet pipe terminating in the liquid at a level, such that the pressure head defined where the inlet pipe terminates in the liquid is substantially greater than the pressure head defined in the supply pipe;

the inlet opening having a bottom edge and the discharge opening having a top edge, the bottom edge of the inlet opening being positioned at a level being higher than the top edge of the discharge opening; and the inlet pipe being valve-free, whereby the inlet pipe is open during the entire operation of the pump arrangement so that the pump may pump liquids containing solid objects.

2. The pump arrangement of claim 1, wherein the pump chamber is oblong, substantially cylindrical in shape, the pump chamber further being inclined downwardly from the inlet opening to the discharge opening.

3. The pump arrangement of claim 1, wherein a sensor is provided, the sensor controlling the valve in the supply pipe, wherein when the liquid in the discharge pipe is at a predetermined level, the sensor is activated, the sensor controls the valve to permit compressed air from the source thereof to pass into the chamber and when the sensor is deactivated, the sensor controls the valve permitting the compressed air from the source thereof to be vented to the ambient environment.

4. The pump arrangement of claim 1, wherein the pump chamber is oblong, substantially cylindrical in shape, the pump chamber further being positioned substantially horizontally.

5. The pump arrangement of claim 4, wherein the inlet opening further has a top edge, and wherein the top edge of the inlet opening is substantially above the top of the pump chamber.

6. The pump arrangement of claim 4, wherein the pump chamber has an upper edge and a lower edge, the bottom edge of the inlet opening being located intermediately of the lower edge and the upper edge of the pump chamber.

7. The pump arrangement of claim 4, wherein the pump chamber has a lower edge, the bottom edge of the inlet opening being located at a higher level than the upper edge of the pump chamber.

* * * * *